US006415867B1

(12) United States Patent
Deul et al.

(10) Patent No.: US 6,415,867 B1
(45) Date of Patent: Jul. 9, 2002

(54) ALUMINUM RISER APPARATUS, SYSTEM AND METHOD

(75) Inventors: Hans Herman Jacques Deul, Richmond, TX (US); Peter Mackinnon Keith Campsie, Rio De Janeiro (BR); Mikhail Yakovlevich Gelfgat, Moscow (RU)

(73) Assignee: Noble Drilling Corporation, Sugarland, TX (US)

( * ) Notice: Subject to any disclaimer, the term of this patent is extended or adjusted under 35 U.S.C. 154(b) by 0 days.

(21) Appl. No.: 09/603,246

(22) Filed: Jun. 23, 2000

(51) Int. Cl.[7] ..... E21B 17/00
(52) U.S. Cl. ..... 166/367; 166/345; 405/195.1
(58) Field of Search ..... 166/367, 341, 166/342, 345, 359, 350; 405/195.1, 224.3

(56) References Cited

U.S. PATENT DOCUMENTS

| | | | | |
|---|---|---|---|---|
| 3,605,413 A | * | 9/1971 | Morgan | 405/211 |
| 3,933,108 A | | 1/1976 | Baugh | |
| 4,183,562 A | | 1/1980 | Watkins et al. | |
| 4,188,156 A | * | 2/1980 | Fisher et al. | 405/195 |
| 4,495,999 A | | 1/1985 | Sykora | |
| 4,573,714 A | | 3/1986 | Sweeney | |
| 4,634,314 A | * | 1/1987 | Pierce | 405/195 |
| 5,439,323 A | | 8/1995 | Nance | |
| 5,474,132 A | | 12/1995 | Gallagher | |
| 5,727,630 A | | 3/1998 | Brammer | |
| 5,813,467 A | | 9/1998 | Anderson et al. | |
| 5,992,893 A | | 11/1999 | Watkins | |
| 6,032,742 A | | 3/2000 | Tomlin et al. | |

FOREIGN PATENT DOCUMENTS

EP 0 654 320 A1 5/1995

OTHER PUBLICATIONS

Tikhonov et al.: "Selection of parameters and bending vibrations of deepwater drilling aluminium riser in random waves" 17th Int Conf On Offshore Mechanics And Arctic Engineering, Jul. 5–9, 1998, XP001027925, Lisbon, Portugal.

Fine et al.: "Aluminium alloys for offshare drilling systems" 14th ASME et al Offshore Mech & Arctic Eng Int Conf, Jun. 18–22, 1995, pp. 299–306, XP001027935, Copenhagen, Denmark.

* cited by examiner

*Primary Examiner*—Frank Tsay
(74) *Attorney, Agent, or Firm*—Thompson & Knight, LLP; H. Lisa Calico; Aaron A. Weiss

(57) ABSTRACT

An apparatus, system and method of manufacturing a marine riser constructed of an aluminum alloy having a high strength-to-weight ratio is provided. The inventive riser apparatus comprises a plurality of riser sections coupled serially end-to-end, wherein each of the riser section comprises a pipe having a first end and a second end, a first flanged coupling welded to the first end of the pipe, and a second flanged coupling welded to the second end of the pipe, wherein the pipe is constructed of an aluminum alloy having a strength-to-weight ratio greater than that of steel. The riser apparatus may optionally include one or more auxiliary lines providing hydraulic communication with a blowout preventer. A method of manufacturing the inventive riser is also disclosed, comprising the steps of forming a first weld between a first flanged coupling and a first end of a pipe, forming a second weld between a second flanged coupling and a second end of the pipe, and heating the welds at a temperature sufficient for annealing the welds, wherein the material used for the welding is composed of an aluminum alloy having a strength-to-weight ratio greater than that of steel. By using a riser of a material having a high strength-to-weight ratio, excellent weldability characteristics, and resistance to corrosion, the present invention allows for offshore drilling operations in deeper waters, increased deckload capacity, and reduced costs.

46 Claims, 4 Drawing Sheets

ALUMINUM RISER APPARATUS, SYSTEM AND METHOD

FIELD OF THE INVENTION

The present invention relates generally to the field of exploration and production of oil and other fossil fuels from a well, and more particularly, to a strong, lightweight aluminum riser apparatus, system and method of manufacturing same for use in offshore drilling and production.

BACKGROUND OF THE INVENTION

Offshore drilling rigs, such as fixed platforms, jack-up platforms, floating and/or semi-submersible platforms, and dynamically positioned drill ships, are used in the production of hydrocarbons from under the floor of large bodies of water. A riser string is typically provided between the floating rig and the wellhead at the ocean floor. A conventional marine riser comprises a cylindrical pipe or column made of ferrous metal, e.g., steel, which is positioned vertically between the seabed and a drilling platform at the surface. The riser typically comprises a plurality of sections or joints connected end to end in a string between the surface and the wellbore.

A significant drawback to using riser constructed of steel is its high density and significant weight. A steel riser with adequate wall thickness to meet pressure requirements adds significant weight to the rig. The weight of the riser can substantially limit the payload capacity available for other necessary equipment and staff on the rig. Not only must each section be strong enough to carry the load of other sections, but also existing platforms can only carry a limited number of sections without exceeding their maximum load limit. A riser of inadequate strength can lead to failure of the equipment and can present a danger to the personnel on the platform.

Buoyancy modules are typically fitted to reduce the submerged weight. Top-tension is then applied to the riser string to prevent buckling of the string due to the weight of fluid in the bore of the riser and sea currents.

An increasing demand for drilling in greater depths of water has required additional riser pipe to be used in order to span the distance from the ocean floor to the floating platform. The added weight of the riser becomes a significant problem and a limiting factor at greater depths of water. Consequently, using a conventional steel riser at greater depths of water requires sacrificing even more valuable payload capacity to carry the necessary riser pipe. In addition, the added weight of a steel riser can increase the amount of fuel consumption and therefore increase costs of operations.

The use of a lighter weight material such as titanium has been described in the prior art. The high cost of titanium, however, is a significant disadvantage that renders its use impractical. Furthermore, the use of aluminum risers has not been previously executed with success, since common aluminum alloys lack the requisite strength properties.

A need has therefore arisen for a system, apparatus and method for drilling offshore that overcomes the limitations of the prior art. A riser composed of a material having a high strength-to-weight ratio and resistance to corrosion while reducing the overall weight of the drilling equipment would be a sorely needed improvement upon the prior art. Such an improved riser would allow offshore oil production at greater depths of water without increasing equipment costs, or jeopardizing the safety and security of the drilling operations.

SUMMARY OF THE INVENTION

Accordingly, the present invention provides an improved riser for use in offshore drilling operations. In accordance with a preferred embodiment of the present invention, a riser apparatus for use in offshore drilling comprises a plurality of riser sections coupled serially end-to-end, wherein each of the riser sections comprises a pipe having a first end and a second end, a first flanged coupling welded to the first end of the pipe, and a second flanged coupling welded to the second end of the pipe, wherein the pipe is constructed of an aluminum alloy having a strength-to-weight ratio greater than that of steel. The riser apparatus may optionally include one or more auxiliary lines providing hydraulic communication with a blowout preventer. The auxiliary lines may include without limitation choke and kill lines, hydraulic lines, and booster lines. In connection with the provision of auxiliary lines, telescoping joints may also be provided to allow for stretching of the riser with the movement of the floating rig due to factors such as ocean currents, waves, and the wind.

A preferred method of manufacturing the inventive riser is also disclosed, comprising the steps of welding a first flanged coupling to a first end of a pipe, welding a second flanged coupling to a second end of the pipe, and heating the welds at a temperature below the melting point of the welds sufficiently high to anneal the welds, wherein the material used for the welds is composed of an aluminum alloy having a strength-to-weight ratio greater than that of steel.

An object of the present invention is to provide a riser that is lighter than conventional steel riser, while still meeting pressure and strength requirements. By using a riser of a material having a high strength-to-weight ratio, excellent weldability characteristics, and resistance to corrosion, the present invention allows for a longer riser string as needed in offshore drilling operations in deeper waters.

Another advantage of the riser according to the present invention is that the lighter weight of the inventive riser allows for increased deck load capacity for equipment and operating supplies. The decreased weight of the inventive riser reduces the amount of top tension required and use of buoyancy modules. By reducing the amount of top tension, smaller tensioner units can be employed, thereby freeing even more deck space. The decreased weight of the inventive riser also reduces overall costs of the offshore drilling operations.

For a more complete understanding of the present invention, including its features and advantages, reference is now made to the following detailed description, taken in conjunction with the accompanying drawings.

BRIEF DESCRIPTION OF THE DRAWINGS

Other objects, advantages, features and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

Corresponding numerals and symbols in the different figures refer to corresponding parts unless otherwise indicated.

DETAILED DESCRIPTION OF A PREFERRED EMBODIMENT OF THE INVENTION

Figure 1:
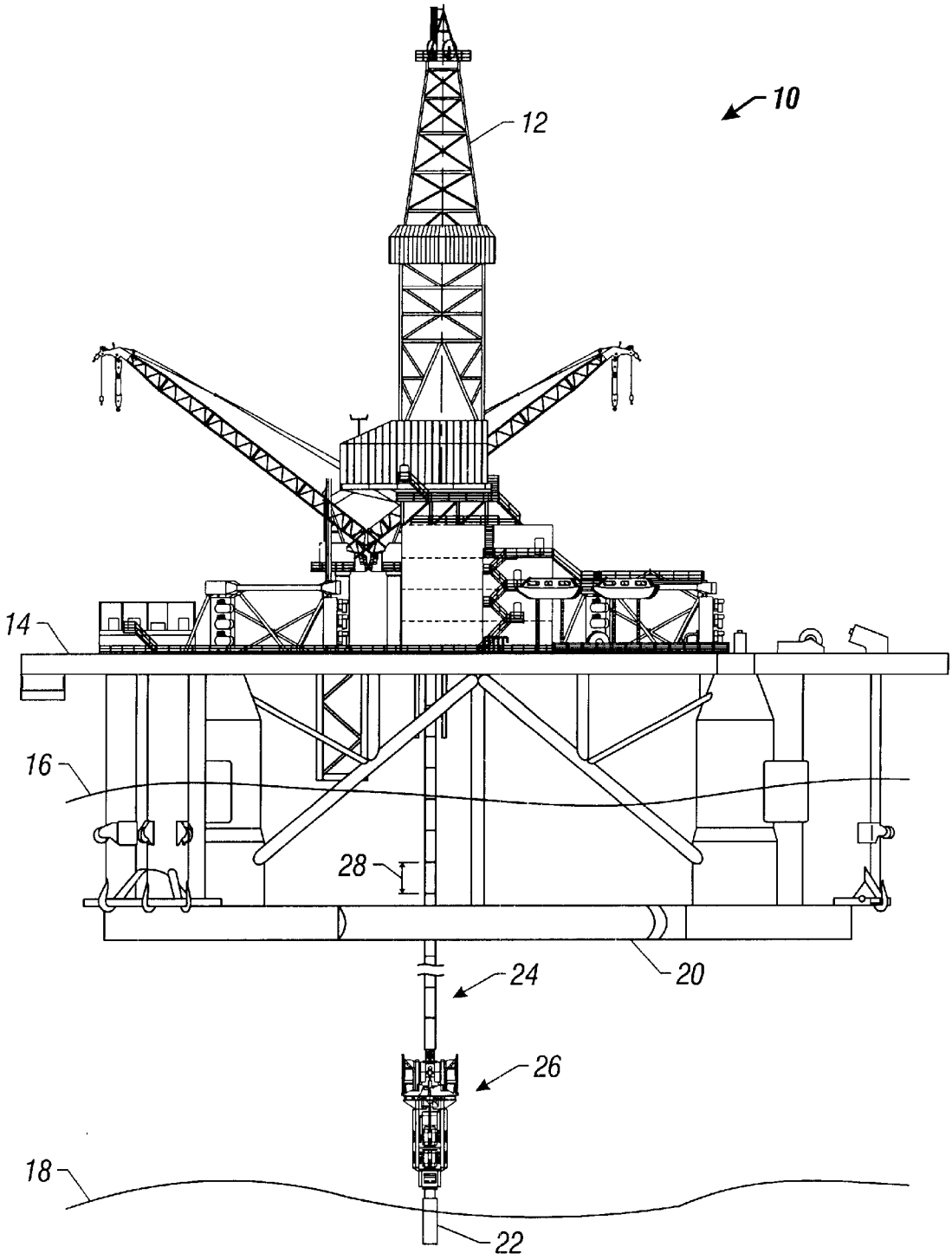
FIG. 1 is a side view of an offshore drilling rig system in accordance with one embodiment of the present invention.

Reference is now made to FIG. 1, in which an offshore drilling rig is designated generally by the numeral 10 for illustrating the context of the present invention. While offshore drilling rig 10 is depicted as a semi-submersible drilling system, it will be appreciated by those skilled in the art that the apparatus, system and method of the present invention find equal application to other types of drilling rigs, such as drill ships and the like.

Offshore drilling rig 10 comprises a derrick 12 carried by a platform 14. Platform 14 floats in a body of water 16 over a seabed 18 with the support of one or more pontoons 20. Derrick 12 functions primarily to drill a wellbore 22 if deployed and to pump oil and other fossil fuels from a well.

A riser 24 extends from platform 14 to drilling equipment and a blowout preventer (BOP) 26, which comprises a series of valves that can close to prevent any accidental blowouts. At the lower end of riser 24 a drill bit (not shown) is provided, extending into wellbore 22. The primary functions of riser 24 are to guide drill pipe and tools to the wellbore 22 and to provide a return pathway for drilling mud which is circulated therein.

Riser 24 comprises a plurality of elongated riser joints or riser sections 28 coupled together. It is desireable that each of the riser sections 28 has a high strength-to-weight ratio, such that each riser section 28 can resist the pressure of the materials enclosed within, as well as accommodate the deckload, and the load caused by the suspension of additional riser sections 28. It is further desireable that riser sections 28 be capable of withstanding the heat and corrosive effects of drilling mud as well as the salt water.

Figure 2:
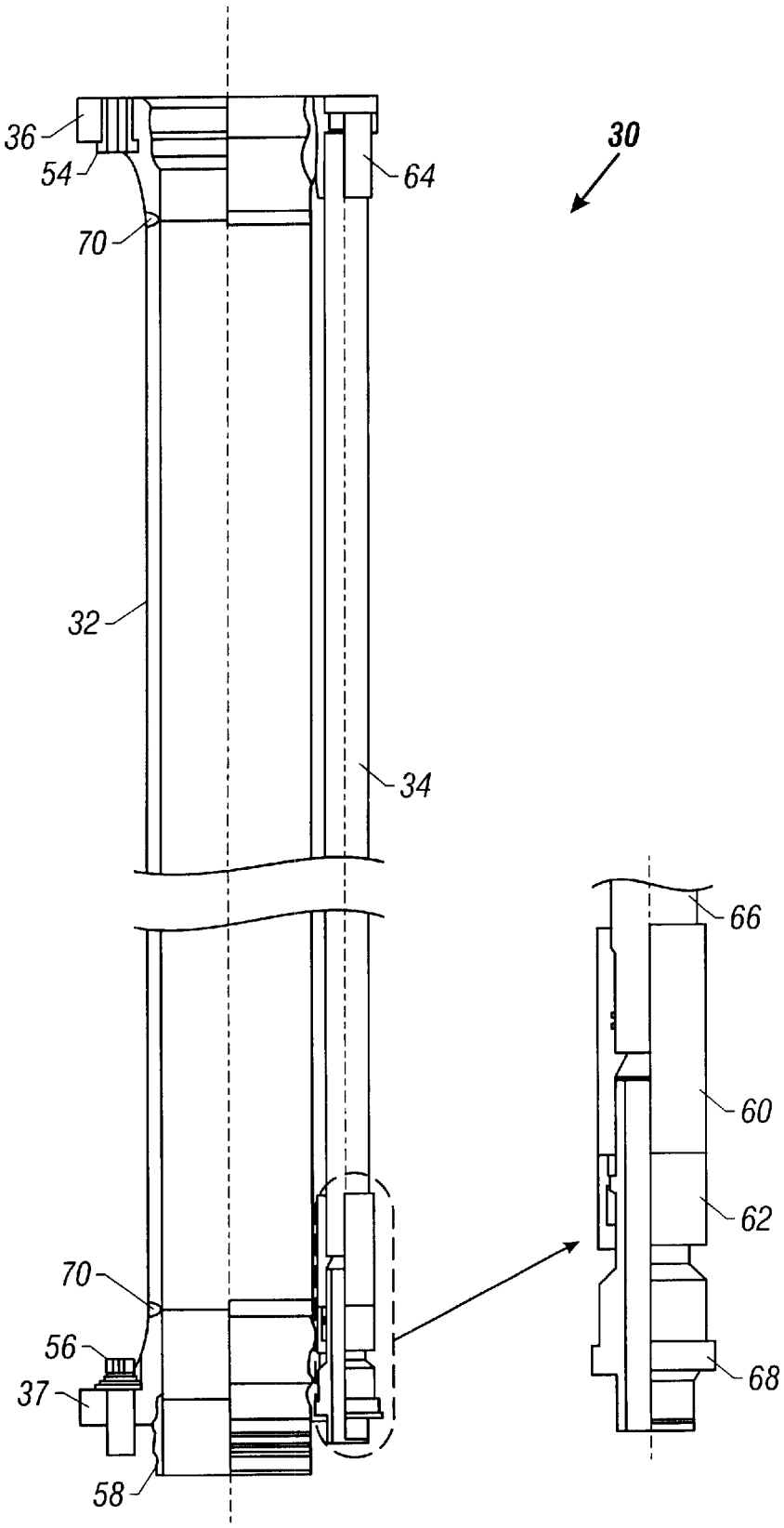
FIG. 2 is a partial sectional view of a section of a riser in accordance with a preferred embodiment of the present invention.

A single riser section (or riser joint) according to a preferred embodiment of the present invention is illustrated in FIG. 2, and designated generally by reference numeral 30. Riser section 30 is comprised of a generally cylindrical pipe 32, one or more auxiliary lines 34, and may also comprise a buoyancy module (not shown for ease of illustration). Buoyancy modules may comprise two half moon pieces bolted to each other and clamped around pipe 32. Each buoyancy module is typically constructed of syntactic foam containing air-filled balls. The size of the balls can be varied to provide either more or less buoyancy. Other suitable buoyancy modules may be used consistent with the present invention.

A flanged coupling 36 and a flanged coupling 37 are welded to each end of pipe 32. Flanged coupling 36 is depicted in FIG. 2 as a box coupling, while flanged coupling 37 is depicted as a pin coupling. Preferably, pipe 32, flanged coupling 36 and flanged coupling 37 are manufactured from a material having the following properties: a minimum yield strength of approximately 50,250 lbs/in$^2$, an ultimate tensile strength (UTS) of at least approximately 58,750 lbs/in$^2$, and a modulus of elasticity of approximately $10\times10^6$ lbs/in$^2$. In one embodiment of the present invention, but not necessarily, the material has a density of approximately one-third the density of steel.

The foregoing properties are embodied in an alloy of aluminum, zinc, and magnesium, commercially available under the Russian designation AL 1980. AL 1980 is a preferred material due to its high strength properties combined with its low density. In addition, AL 1980 exhibits excellent resistance to corrosion, and resists becoming brittle when exposed to hydrogen sulfide ($H_2S$). Furthermore, AL 1980 demonstrates excellent weldability characteristics. It should be noted that while AL 1980 is a preferred material for the present invention, upon reviewing this disclosure, those skilled in the art will recognize that other aluminum alloys may be used to practice the present invention.

Figure 3A:
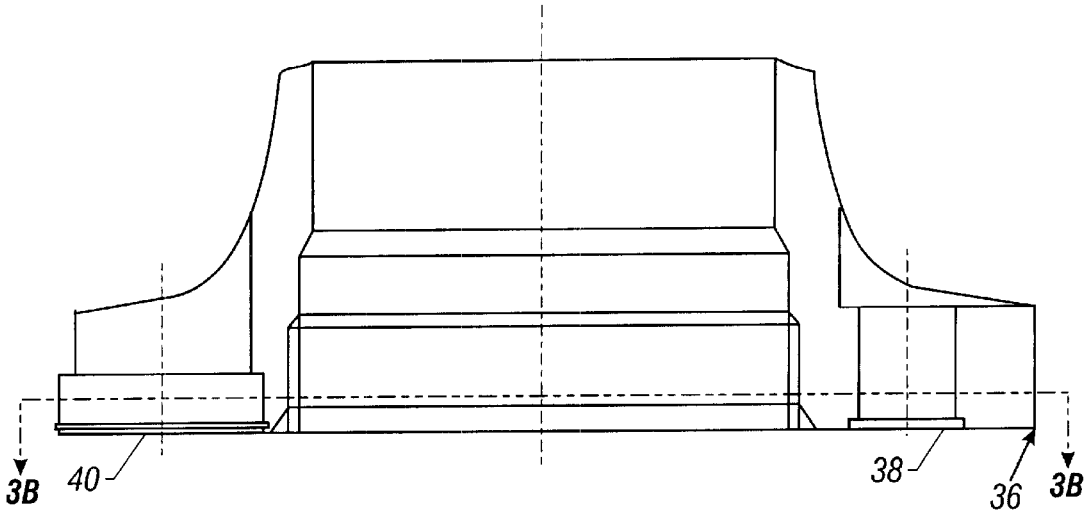
FIG. 3A is a side view of a flange coupling in accordance with a preferred embodiment of the present invention.
Figure 3B:
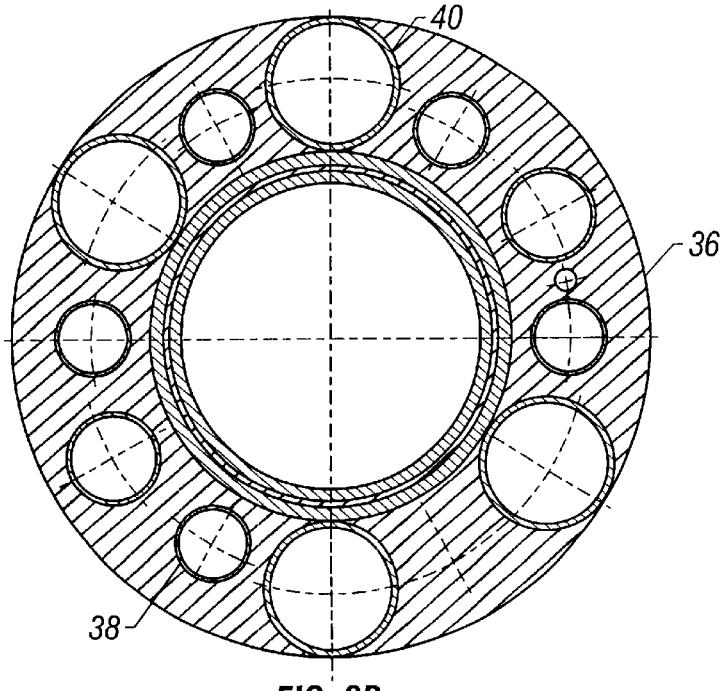
FIG. 3B is a cross-sectional view of a flange coupling in accordance with a preferred embodiment of the present invention.

A side view of the flanged coupling 36 of FIG. 2 is illustrated in FIG. 3A, and a cross-sectional view of flanged coupling 36 is illustrated in FIG. 3B. Flanged coupling 36 includes a locking mechanism generally used to securely connect two sections of riser pipe together. This locking mechanism comprises a series of bolts and threaded insert locations 38. Flanged coupling 36 further includes openings 40 for guiding auxiliary lines 34.

Riser sections constructed according to a preferred embodiment of the present invention exhibit a tensile capacity of approximately 2,000,000 lbs (with substantially zero bending), and a bending capacity of approximately 950,000 ft-lbs (under substantially zero tension). Additionally, a section joint manufactured from the preferred aluminum alloy AL 1980 weighs approximately 12,500 pounds in air. Compared to a conventional steel riser section exhibiting the same tensile capacity and bending capacity yet weighing approximately 22,000 pounds, the inventive riser section is almost half the weight of the steel section.

Referring again to FIG. 2, the auxiliary lines 34 may include, but are not limited to, choke and kill pipes, hydraulic pipes, and booster pipes. Auxiliary lines 34 are positioned outside pipe 32, and function to provide hydraulic communication to a BOP and wellhead. Auxiliary lines 34 are preferably manufactured from a material having a relative higher yield strength and UTS compared to pipe 32 of FIG. 2. A preferred embodiment of the present invention uses a material having a minimum yield strength of approximately 71,050 lbs/in$^2$ and a UTS of at least approximately 76,850 lbs/in$^2$. An example of such a material is an aluminum, zinc, magnesium, and copper alloy commercially available under the Russian designation AL 1953. Auxiliary lines 34 may also be constructed from the AL 1980 series of aluminum alloys.

The riser section 30 of FIG. 2 also includes a threaded insert 54, a bolt 56 and a nose pin 58 for securely coupling a string or series of riser sections 30 together. Riser section 30 further includes an auxiliary line socket 60, an auxiliary line lock nut 62, an auxiliary line box 64, an auxiliary line pipe 66 and an auxiliary line telescoping pin 68 for securing each auxiliary line 34 in a manner that will be appreciated by those skilled in the art. Telescoping pin 68 effectively functions to provide a gap between the couplings of the riser sections 30 to allow for stretching movement.

FIG. 2 also depicts welds 70 between one end of pipe 32 and flanged coupling 36, and between the other end of pipe 32 and flanged coupling 37. Welds 70 may also be used to weld two generally cylindrical pipe segments together. Welds 70 are preferably composed a material having low weight and high strength properties, such as AL 1980.

Following the completion of a series of operations for manufacturing the riser, including welding of pipe 32 to the flanged couplings 36 and 37, in accordance with a preferred embodiment of the invention, welds 70 undergo an annealing process. During the annealing process, welds 70 are subjected to local heat treatment which effects change in the molecular structure of the welds 70, which in turn strengthens the welds 70 and the entire riser string.

Figure 4:
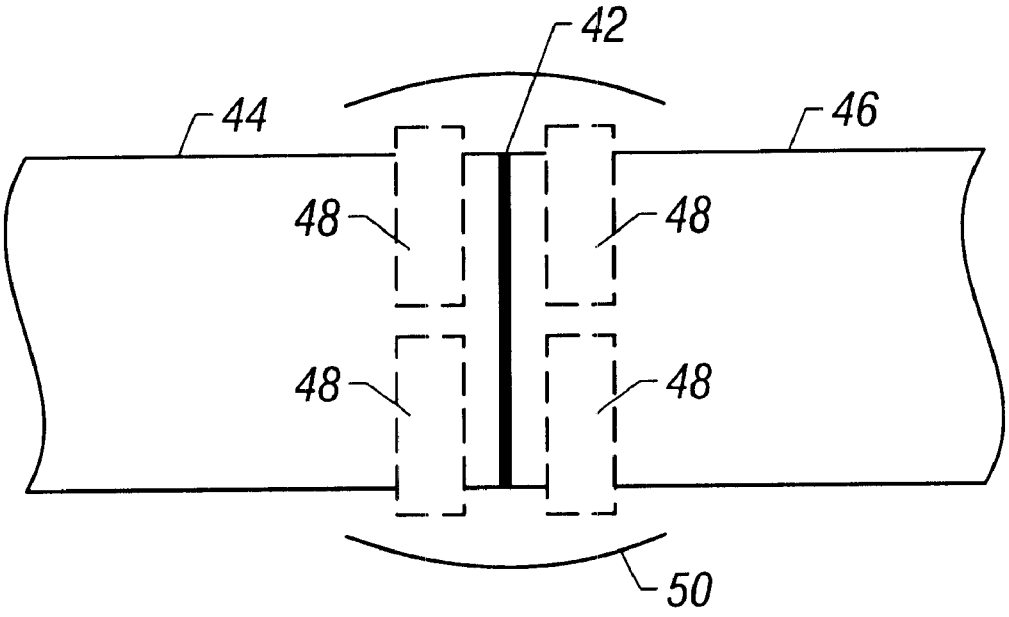
FIG. 4 is a block diagram of a weld between two cylindrical pipe segments during the annealing process.

Reference is now made to FIG. 4, which depicts a block diagram of a weld 42 used to join two cylindrical pipe segments 44 and 46 during the annealing process. The annealing process comprises two principal stages. First, weld 42 is subjected to heaters at a temperature of approximately 100° C. As shown in FIG.4, a plurality of heaters 48 are brought in close proximity to weld 42. In a preferred embodiment of the present invention, four semi-circular heaters 48 surround weld 42 and are used to uniformly apply heat to weld 42. Heaters 48 are surrounded by a means for insulation 50. Heaters 48 are controlled by a microcontroller or microprocessor (not shown) that can be programmed according to desired specifications. In accordance with a preferred embodiment of the present invention, the temperature is gradually increased at a rate in the range of approximately 20° C./hr to approximately 40° C./hr. Approximately five hours is sufficient time for this stage.

In the second stage of the annealing process, the temperature is raised to approximately 175° C. at a rate in the range of approximately 20° C./hr to approximately 40° C./hr. The preferred holding time at 175° C. should be approximately 3 hrs. After the holding time period has elapsed, weld 42 is air cooled.

The features and advantages of an aluminum riser prepared in accordance with the present invention have been demonstrated in a comparison study against a ferrous metal (steel) riser. The comparison was carried out on an oil well drilled in a water depth of over 8,000 feet (i.e. 2438.4 meters). It was found that an aluminum riser manufactured in accordance with the present invention required 50 joints out of 106 total joints to be dressed with buoyancy modules, while the conventional steel riser required a total of 103 out of 106 joints to be dressed with buoyancy modules. Due to the reduction in buoyancy modules fitted, and the lower density of the riser of the instant invention, the load acting on the riser storage deck was reduced from 2040 standard tons for a conventional steel riser to 1032 standard tons when employing the inventive riser.

Another comparison was carried out for an oil well in approximately 3,000 meters (i.e. 9842.5 feet) of water in which a riser manufactured according to the present invention required 43 out of 131 joints of riser to be dressed with buoyancy. Assuming a mud weight of 14 pounds per gallon in the bore of the riser, this would require a top tension (based upon API 16Q) of 1428 KIPS. Using the same scenario, a conventional steel riser would require a top tension of 2810 KIPS.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is therefore intended that the appended claims encompass any such modifications or embodiments.

What is claimed is:

1. A method of manufacturing a riser for use in offshore drilling, comprising the steps of:

forming a first weld between a first flanged coupling and a first end of a pipe;

forming a second weld between a second flanged coupling and a second end of the pipe; and heating the first weld at a temperature below the melting point of the riser sections and sufficient to heat treat the first weld;

heating the second weld at a temperature below the melting point of the riser sections and sufficient to heat treat the second weld;

wherein the material used for the weld is composed of an aluminum alloy having a strength-to-weight ratio greater than that of steel.

2. The method of claim 1, wherein the temperature is at least approximately 100° C.

3. A riser comprising a plurality of riser sections coupled end-to-end so as to be axially aligned, wherein the riser is prepared by the method of claim 2.

4. The method of claim 1, wherein the temperature is in the range of approximately 100° C. and approximately 175° C.

5. A riser comprising a plurality of riser sections coupled end-to-end so as to be axially aligned, wherein the riser is prepared by the method of claim 4.

6. The method of claim 1, wherein the aluminum alloy is Russian designation AL 1980.

7. A riser comprising a plurality of riser sections coupled end-to-end so as to be axially aligned, wherein the riser is prepared by the method of claim 6.

8. The method of claim 1, wherein the riser has a minimum yield strength of approximately 50,250 lbs/in$^2$, an ultimate tensile strength of at least approximately 58,750 lbs/in$^2$, and a modulus of elasticity of approximately $10\times10^6$ lbs/in$^2$.

9. A riser comprising a plurality of riser sections coupled end-to-end so as to be axially aligned, wherein the riser is prepared by the method of claim 8.

10. The method of claim 1, wherein the aluminum alloy has a density of approximately one-third or less that of ferrous steel.

11. A riser comprising a plurality of riser sections coupled end-to-end so as to be axially aligned, wherein the riser is prepared by the method of claim 10.

12. The method of claim 1, wherein the riser has a tensile capacity of approximately 2,000,000 pounds or greater, with substantially zero bending.

13. A riser comprising a plurality of riser sections coupled end-to-end so as to be axially aligned, wherein the riser is prepared by the method of claim 12.

14. The method of claim 1, wherein the riser has a bending capacity of approximately 950,000 ft-lb or greater, under substantially zero tension.

15. A riser comprising a plurality of riser sections coupled end-to-end so as to be axially aligned, wherein the riser is prepared by the method of claim 14.

16. The method of claim 1, wherein the material used for the welding is composed of an aluminum alloy known as Russian designation AL 1980.

17. A riser comprising a plurality of riser sections coupled end-to-end so as to be axially aligned, wherein the riser is prepared by the method of claim 16.

18. A riser comprising a plurality of riser sections coupled end-to-end so as to be axially aligned, wherein the riser is prepared by the method of claim 1.

19. A system for offshore drilling or production comprising:

a floating platform;

a derrick coupled to the floating platform; and a riser coupled to the floating platform, wherein the riser comprises a plurality of riser sections coupled end-to-end so as to be axially aligned, and wherein the riser is prepared by the method of claim 1.

20. A riser assembly comprising:

a first riser section including:

a first riser pipe having a first end, and a first connector coupled to the first end by a first weld;

a second riser section including:

a second riser pipe having a second end, and a second connector coupled to the second end by a second weld;

wherein the first weld and the second weld undergo heat treatment such that the first weld and the second weld are each stronger and more flexible after the heat treatment than before the heat treatment; and wherein the first connector is coupled to the second connector such that the first riser section is axially aligned with the second riser section.

21. The riser assembly of claim 20, wherein the first connector comprises a first flange and the second connector comprises a second flange.

22. The riser assembly of claim 21, wherein the flanges are constructed of an aluminum alloy having a greater strength-to-weight ratio than that of steel.

23. The riser assembly of claim 22, further comprising:

an auxiliary line assembly including:

a first auxiliary joint, a second auxiliary joint, and wherein the first auxiliary joint is telescopically coupled to the second auxiliary joint such that the first auxiliary joint and the second auxiliary joint are axially aligned and such that the first auxiliary joint can move axially relative to the second auxiliary joint;

wherein the auxiliary line assembly is passed through an opening of a structure comprising the flanges such that the auxiliary line assembly is approximately parallel to the riser assembly, substantially restrained from lateral movement at the point of passage relative to the opening, and can move axially relative to the riser assembly; and whereby deflection between the flanges under load is allowed.

24. The riser assembly of claim 20, wherein the heat treatment includes:

heating the first weld and the second weld at a first rate to a first temperature; and keeping the first weld and the second weld at at least approximately the first temperature for a first time period.

25. The riser assembly of claim 24, wherein the heat treatment further includes:

heating the first weld and the second weld at a second rate to a second temperature; and keeping the first weld and the second weld at at least approximately the second temperature for a second time period.

26. The riser assembly of claim 25, wherein the heat treatment further includes, after keeping the first weld and the second weld at at least approximately the first temperature for a first time period and before heating the first weld and the second weld at a second rate to a second temperature, air cooling the first weld and the second weld.

27. The riser assembly of claim 26, wherein the first temperature is in the range of approximately 100° C. to approximately 175° C., the first rate is in the range of approximately 20° C. per hour to approximately 40° C. per hour, and the first time period is in the range of approximately 1 hour to approximately 3 hours; and wherein the second temperature is in the range of approximately 100° C. to approximately 175° C., the second rate is in the range of approximately 20° C. per hour to approximately 40° C. per hour, and the second time period is in the range of approximately 1 hour to approximately 3 hours.

28. The riser assembly of claim 27, wherein the first temperature is approximately 100° C. and the first time period is in the range of approximately 1.5 hours to approximately 2 hours; and wherein the second temperature is approximately 175° C. and the second time period is approximately 3 hours.

29. A riser comprising a plurality of riser assemblies of claim 20, coupled end-to-end such that the riser assemblies are axially aligned.

30. The riser of claim 29, wherein each of the first connectors comprises a first flange and each of the second connectors comprises a second flange.

31. The riser of claim 30, wherein each of the flanges is constructed of an aluminum alloy having a greater strength-to-weight ratio than that of steel.

32. The riser of claim 31, wherein each of the riser assemblies further comprises:

an auxiliary line assembly including:

a first auxiliary joint, a second auxiliary joint, and wherein the first auxiliary joint is telescopically coupled to the second auxiliary joint such that the first auxiliary joint and the second auxiliary joint are axially aligned and such that the first auxiliary joint can move axially relative to the second auxiliary joint;

wherein the auxiliary line assembly is passed through an opening of a structure comprising the flanges such that the auxiliary line assembly is approximately parallel to the riser assembly, substantially restrained from lateral movement at the point of passage relative to the opening, and can move axially relative to the riser assembly; and whereby deflection between the flanges under load is allowed.

33. The riser of claim 29, wherein each of the heat treatments includes:

heating the first weld and the second weld at a first rate to a first temperature; and keeping the first weld and the second weld at at least approximately the first temperature for a first time period.

34. The riser of claim 33, wherein each of the heat treatments further includes:

heating the first weld and the second weld at a second rate to a second temperature; and keeping the first weld and the second weld at at least approximately the second temperature for a second time period.

35. The riser of claim 34, wherein each of the heat treatments further includes, after keeping the first weld and the second weld at at least approximately the first temperature for a first time period and before heating the first weld and the second weld at a second rate to a second temperature, air cooling the first weld and the second weld.

36. The riser of claim 35, wherein the first temperature is in the range of approximately 100° C. to approximately 175° C., the first rate is in the range of approximately 20° C. Per hour to approximately 40° C. per hour, and the first time period is in the range of approximately 1 hour to approximately 3 hours; and wherein the second temperature is in the range of approximately 100° C. to approximately 175° C., the second rate is in the range of approximately 20° C. per hour to approximately 40° C. per hour, and the second time period is in the range of approximately 1 hour to approximately 3 hours.

37. The riser of claim 36, wherein the first temperature is approximately 100° C. and the first time period is in the range of approximately 1.5 hours to approximately 2 hours; and wherein the second temperature is approximately 175° C. and the second time period is approximately 3 hours.

38. A system for offshore drilling or production comprising:

a floating platform;

a derrick coupled to the floating platform; and the riser of claim 29, coupled to the floating platform.

39. The system of claim 38, wherein each of the first connectors comprises a first flange and each of the second connectors comprises a second flange.

40. The system of claim 39, wherein each of the flanges is constructed of an aluminum alloy having a greater strength-to-weight ratio than that of steel.

41. The system of claim 40, wherein each of the riser assemblies further comprises:

an auxiliary line assembly including:

a first auxiliary joint, a second auxiliary joint, and wherein the first auxiliary joint is telescopically coupled to the second auxiliary joint such that the first auxiliary joint and the second auxiliary joint are axially aligned and such that the first auxiliary joint can move axially relative to the second auxiliary joint;

wherein the auxiliary line assembly is passed through an opening of a structure comprising the flanges such that the auxiliary line assembly is approximately parallel to the riser assembly, substantially restrained from lateral movement at the point of passage relative to the opening, and can move axially relative to the riser assembly; and whereby deflection between the flanges under load is allowed.

42. The system of claim 38, wherein each of the heat treatments includes:

heating the first weld and the second weld at a first rate to a first temperature; and keeping the first weld and the second weld at at least approximately the first temperature for a first time period.

43. The system of claim 42, wherein each of the heat treatments further includes:

heating the first weld and the second weld at a second rate to a second temperature; and keeping the first weld and the second weld at at least approximately the second temperature for a second time period.

44. The system of claim 43, wherein each of the heat treatments further includes, after keeping the first weld and the second weld at at least approximately the first temperature for a first time period and before heating the first weld and the second weld at a second rate to a second temperature, air cooling the first weld and the second weld.

45. The system of claim 44, wherein the first temperature is in the range of approximately 100° C. to approximately 175° C., the first rate is in the range of approximately 20° C. per hour to approximately 40° C. per hour, and the first time period is in the range of approximately 1 hour to approximately 3 hours; and wherein the second temperature is in the range of approximately 100° C. to approximately 175° C., the second rate is in the range of approximately 20° C. per hour to approximately 40° C. per hour, and the second time period is in the range of approximately 1 hour to approximately 3 hours.

46. The system of claim 45, wherein the first temperature is approximately 100° C. and the first time period is in the range of approximately 1.5 hours to approximately 2 hours; and wherein the second temperature is approximately 175° C. and the second time period is approximately 3 hours.

* * * * *

UNITED STATES PATENT AND TRADEMARK OFFICE

CERTIFICATE OF CORRECTION

PATENT NO. : 6,415,867 B1 
DATED : July 9, 2002
INVENTOR(S) : Hans Herman Jacques Deul et al.

It is certified that error appears in the above-identified patent and that said Letters Patent is hereby corrected as shown below:

Column 9,
Line 10, correct the case of "Per" by replacing it with the word -- per --.

Signed and Sealed this

Third Day of September, 2002

*Attest:*

*Attesting Officer*

JAMES E. ROGAN
*Director of the United States Patent and Trademark Office*